US005330381A

United States Patent [19]

Hutcheson

[11] Patent Number: 5,330,381

[45] Date of Patent: Jul. 19, 1994

[54] GROOVED WHEEL AND STICK TOY

[76] Inventor: Arthur W. Hutcheson, 360 New World Dr., Clairton, Pa. 15025

[21] Appl. No.: 964,063

[22] Filed: Oct. 21, 1992

[51] Int. Cl.[5] ..... A63H 33/02

[52] U.S. Cl. ..... 446/450

[58] Field of Search ..... 446/168, 236, 240, 444, 446/450, 451, 452, 453, 489, 431, 445, 447, 411-412, 448, 449; 273/57.2, 67 A, 108, 126 R, 128 A, 128 R, 129 A, 129 R

[56] References Cited

U.S. PATENT DOCUMENTS 1,779,187 10/1930 Pearson ..... 273/129 R

FOREIGN PATENT DOCUMENTS 1141958 3/1983 Canada ..... 446/450

*Primary Examiner*—Robert A. Hafer
*Assistant Examiner*—Jeffrey D. Carlson
*Attorney, Agent, or Firm*—John P. Halvonik

[57] ABSTRACT

The invention is an amusement device comprising a control arm generally in the form of a stick and a rolling toy in the form of a wheel. The stick is used to move the wheel in various directions. The inventive portion of the device lies in a series of grooves in the wheel and a corresponding series of grooves in the bottom, or blade, of the control arm. The use of the grooves enables one to efficiently and quickly control the speed and movement of the wheel.

5 Claims, 3 Drawing Sheets

GROOVED WHEEL AND STICK TOY

BACKGROUND OF THE INVENTION

1. Field of the Invention

The invention relates to the field of wheel and stick type toys where a stick resembling, say a hockey stick, is used to propel a wheeled device. More particularly, the stick portion and the wheel portion of the amusement device come with notched or grooved surfaces in each in order to more easily control the speed and direction of the wheel.

2. Description of the Prior Art

There are amusement devices that use a stick or a blade in order to control a device in the form of a tire or a ball that is manipulated by the stick. However, there are none that applicant is aware of that have a series of grooves cross wise across both the wheel and the stick in order for the two to work together more efficiently.

SUMMARY OF THE INVENTION

The invention is an improved wheel and stick amusement device. The stick portion is a handled member having a lower portion or blade portion. The handle portion is controlled by the user of the device to manipulate the wheel to move it. The blade portion has a series of grooves in the lower surface of the blade designed to contact similar grooves in the wheel. The wheel has a series of grooves running across the width of the bottom surface of the wheel. The bottom surface of the wheel would be where the tread portion would normally be on, say, a tire.

Another object of the invention is to provide a wheel and stick amusement device that uses a stick and/or blade that can impart spin and a great degree of control on the wheel.

Yet another objective is to provide a wheel and stick amusement device that uses a series of recessed portions or grooves on the surfaces of both the stick or blade and the wheel in order to provide greater control on the wheel than previous wheel and stick devices.

Still another objective of the invention is to provide an amusement toy of the stick and wheel variety, that allows the stick to control the wheel to a greater extent possible in terms of speed and direction.

Yet another object is to provide a wheel and stick amusement device that demands greater dexterity and skill than previous amusement devices.

Other objectives of the invention will become apparent to those skilled in the art once the the invention has been shown and described.

DESCRIPTION OF THE PREFERRED EMBODIMENT

Figure 1:
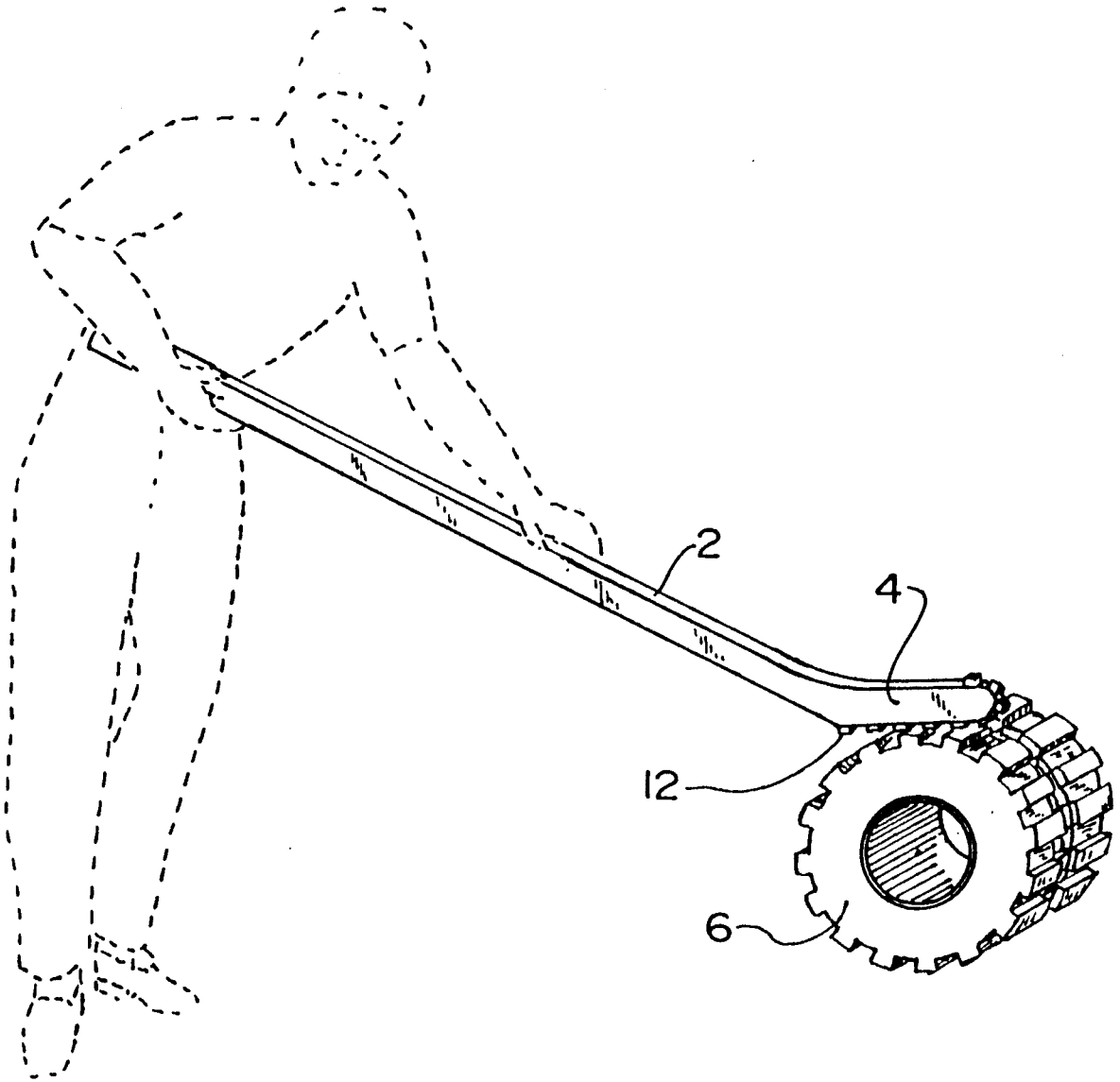
FIG. 1 shows the amusement device in use.
Figure 3:
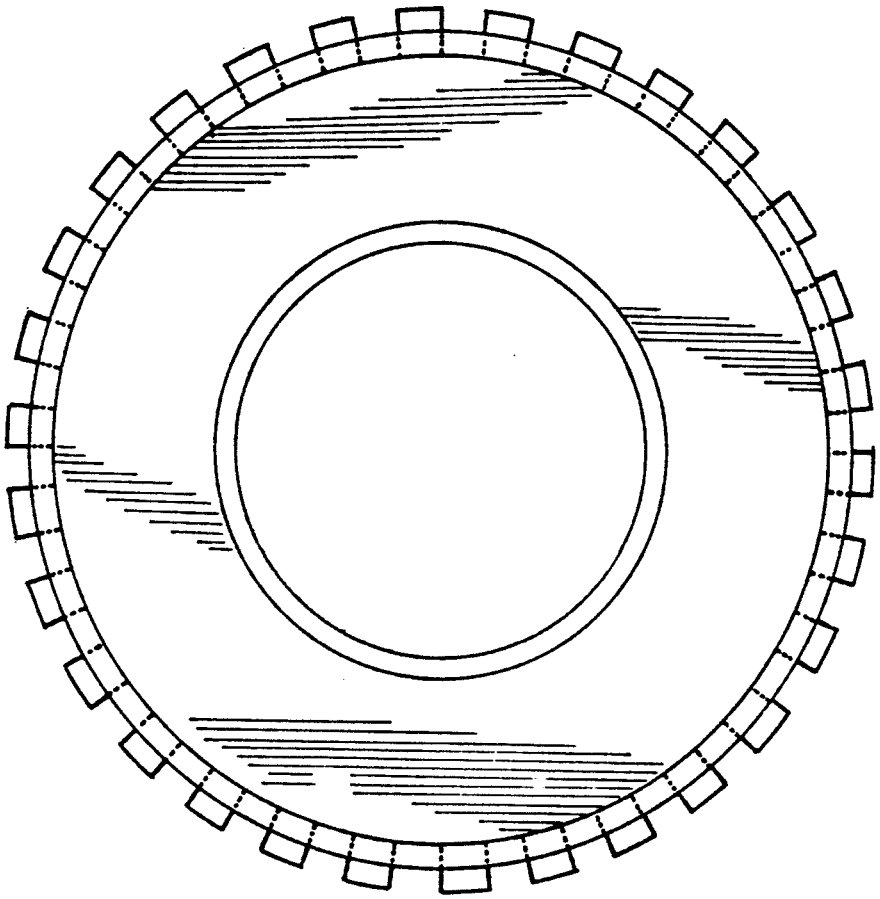
FIG. 3 shows side view of wheel.
Figure 2:
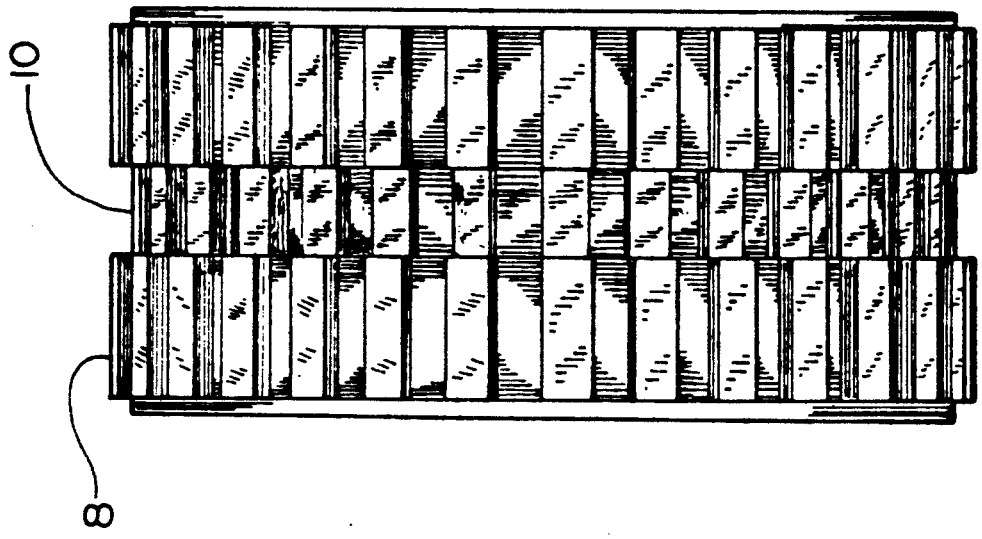
FIG. 2 shows front of wheel showing grooves.
Figures 4, 5:
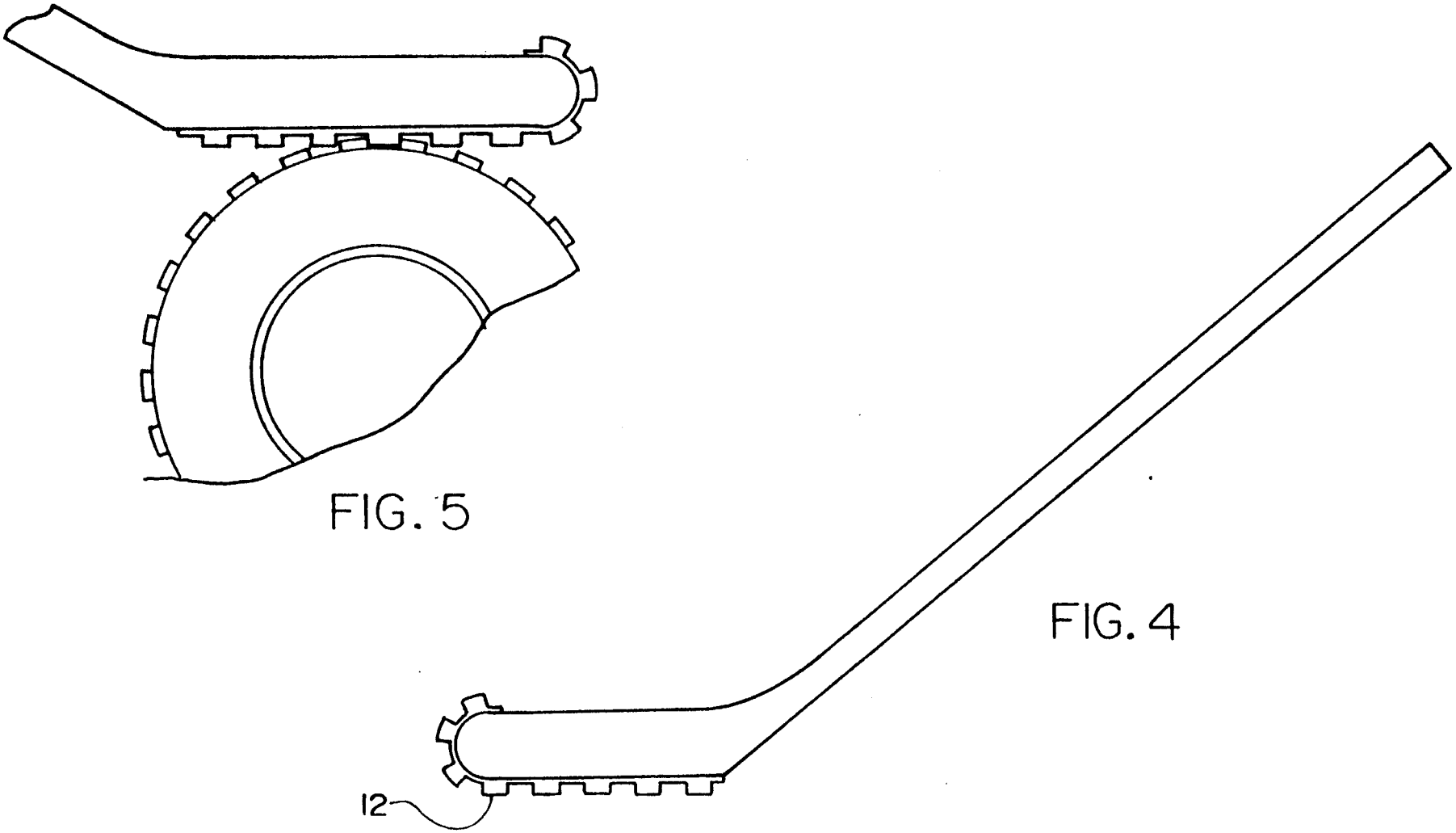
FIG. 4 shows control arm.
FIG. 5 detail of contact of arm and wheel.

The overall construction of the wheel is shown in FIG. 2 and 3 and the overall construction of the stick is shown in FIG. 4. The stick and the wheel work in conjunction with each other and the user manipulates the movement of the wheel with the stick. Both stick and wheel have a series of grooves on the surfaces of each in order for the grooves on the stick to efficiently control the wheel.

The stick 2 may also be referred to as a control arm as it is designed to control the movement of the wheel. The bottom portion of the stick may be thought of as a blade 4 as it is similar to the blade of a hockey stick. The bottom surface of the blade has a series of grooves 12 running across the width of the stick as shown. The grooves should be about ½" to 1" deep. Note the bottom surface of the blade is rather narrow (probably less than 2" wide) as it needs to fit within the two outer grooves for the initial start up of the wheel.

While referred to as grooves, these portions may also be thought of as the areas between raised up portions on the bottom of the blade. It should be clear that raised up portions can create recessed portions or grooves in the areas between the raised up portions.

The wheel 6 is in the general shape of a wheel or tire. It should be about 20" in diameter more or less. The width of the wheel should be about 9". That is, the distance across the tread portion of the wheel. The wheel comes with a series of grooves running across the width (or tread portion ) as shown in FIG. 2 and 3.

There are, preferably, three sets of grooves, each set or series running around the width of the wheel as shown in FIG. 2. There are two sets of outer grooves 8 near the outside edge of the tread of the wheel and a third, inner, series of grooves 10 in the center of the tread. Each groove of the two outer sets of grooves should be about 3 ½" across and the grooves of the inner set should be about 1–2" across. The actual sizes may of course vary considerably without violating the spirit of the invention. The grooves may be spaced apart from one another about –2". If the grooves are 1" apart and each groove is 1" wide then there will be approximately 30 grooves in a 60" diameter wheel. The inner series of grooves is counter sunk in relation to the outer two series. This provides the inner series at little deeper depth than the outer two. The inner series of grooves should be counter sunk at least about ½" to 1" deeper than the outer two series.

Aside from the series of grooves on the wheel there is a second set of grooves on the bottom portion of the stick. The bottom portion may be referred to as the blade. These grooves also run across the width of the bottom surface of the blade of the stick. The grooves are of about the same depth on the stick and the wheel.

The center grooves in the wheel are used to initially start the wheel off by turning with the stick. Having a series of grooves in the center allows one to start the wheel off in an initially straight direction, as opposed to using the grooves on either side. The outer grooves are used to control the speed and direction of the wheel after it has already begun moving. The use of a series of grooves also demands a greater challenge because the grooves must mesh with each other as the blade of the stick contacts the wheel.

The grooves themselves should be about ½" to 1" deep. It is preferred that the grooves be straight across the width of the tread.

I claim:

1. A wheel and stick amusement toy comprising: a stick portion comprising a handle and a blade portion, said blade portion having a series of grooves, a wheel portion having a tread surface, said tread surface running along the periphery of said wheel and having two outer grooved surfaces and an inner grooved surface, said inner grooved surface between said outer surfaces, said outer grooved surfaces describing a circle with a first diameter, and said inner grooved surface describing a circle with a second diameter smaller than said first diameter so that said inner grooved surface forms a channel between said outer grooved surfaces.

2. The apparatus of claim 1 where said grooved surfaces are about ½" to 1" in depth.

3. The apparatus of claim 2 wherein said second diameter is about ½–1" less than said first diameter.

4. The apparatus of claim 3 wherein said wheel has a diameter of about 20 ".

5. The apparatus of claim 4 wherein said wheel has a width of about 9".

* * * * *